US005941405A

United States Patent [19]

Scales et al.

[11] Patent Number: 5,941,405

[45] Date of Patent: Aug. 24, 1999

[54] COLLAPSIBLE AIRLINE CARGO CONTAINER

[76] Inventors: Peter Bruce Scales, 2159 Monterey Avenue, Coquitlam, British Columbia, Canada, V3K 2M5; Robert Todd Banks, 5440 Colbeck Road, Richmond, British Columbia, Canada, V7C 3E5

[21] Appl. No.: 08/759,959

[22] Filed: Dec. 3, 1996

[51] Int. Cl.[6] ..... A45C 7/00; B65D 88/52

[52] U.S. Cl. ..... 220/1.5; 220/4.28; 220/6; 220/9.2; 220/668

[58] Field of Search ..... 220/1.5, 9.1, 9.2, 220/7, 6, 4.28, 9.4, 668; 52/79.5; 135/128, 143, 151, 152, 153; 296/27

[56] References Cited

U.S. PATENT DOCUMENTS

| | | | |
|---|---|---|---|
| 1,133,648 | 3/1915 | Leary | 220/9.2 |
| 3,410,328 | 11/1968 | Sasai | 220/9.2 |
| 3,578,050 | 5/1971 | Weingarten et al. . | |
| 3,618,803 | 11/1971 | Dobberkau et al. | 220/6 X |
| 3,645,596 | 2/1972 | Russell-French | 220/6 X |
| 3,756,498 | 9/1973 | Anderson . | |
| 3,765,556 | 10/1973 | Baer . | |
| 3,799,384 | 3/1974 | Hurkamp . | |
| 3,917,154 | 11/1975 | Dove . | |
| 3,966,285 | 6/1976 | Porch et al. . | |
| 4,538,663 | 9/1985 | Looker . | |
| 4,684,034 | 8/1987 | Ono et al. | 220/7 X |
| 4,735,330 | 4/1988 | Hoss | 220/6 |
| 4,860,912 | 8/1989 | Kupersmit . | |
| 5,109,998 | 5/1992 | Bretschneider . | |
| 5,217,132 | 6/1993 | Looker . | |
| 5,279,437 | 1/1994 | Kupersmit . | |
| 5,289,933 | 3/1994 | Streich et al. . | |
| 5,328,042 | 7/1994 | Heise . | |
| 5,388,702 | 2/1995 | Jones . | |
| 5,437,384 | 8/1995 | Farrell | 220/9.2 X |
| 5,622,277 | 4/1997 | Van Giezen et al. | 220/6 |

*Primary Examiner*—Stephen Castellano
*Assistant Examiner*—Niki M. Eloshway
*Attorney, Agent, or Firm*—Oyen Wiggs Green & Mutala

[57] ABSTRACT

A collapsible cargo container for aircraft. The container comprises a base and roof preferably constructed from aluminum and flexible side walls formed from light weight fabric. The roof is releasably supported in the erected position by foldable support posts which extend upwardly from each comer of the container base. The roof is vertically slidable relative to the support posts between the erected position and a collapsed position proximate to the base. In the collapsed position, the flexible walls are stowed between the base and the roof. The support posts are pivotably coupled to the base and may be folded to a collapsed position resting on an upper surface of the roof. The container may further include a pallet extension to conform to the dimensions of below-deck aircraft cargo holds. The pallet extension is pivotally coupled to the container base and is adjustable between a deployed position extending outwardly of the base at one end of the container and a collapsed position resting on the upper surface of the base. In the fully collapsed position, the container is approximately 15–20% of its erected height.

32 Claims, 20 Drawing Sheets

COLLAPSIBLE AIRLINE CARGO CONTAINER

FIELD OF THE INVENTION

This application relates to a collapsible, light weight container particularly suited for aircraft. The container is adjustable between an erected position for carrying a load in an aircraft cargo hold and a collapsed position for shipping or storing the container without a load.

BACKGROUND OF THE INVENTION

In the airline industry, cargo is typically transported inside containers referred to as "unit load devices" which are stowed in cargo holds below the deck of the aircraft. The size and shape of unit load devices vary depending upon the type of aircraft in use. For example, "LD3" unit load devices have a "pallet extension" at one end to conform to the curved sidewalls of the cargo hold compartments of a Boeing 747 or a Macdonnell Douglas DC 10 aircraft (the fuselage of such aircraft is round or oval in cross-section).

Most airlines have a fleet of different types of aircraft. Very often cargo containers shipped to a destination in one type of aircraft cannot be efficiently returned to the place of origin in another type of aircraft due to the different cargo hold configurations. This results in expensive inventory and storage problems. Often large numbers of cargo containers must be repositioned by some other mode of transportation. Since cargo containers are bulky, they are usually disassembled prior to shipment without a load. The containers must then be reassembled at the place of origin before they are reused.

The weight of cargo containers is a significant factor when calculating aircraft fuel burn. The air cargo industry is therefore seeking lighter weight cargo containers to lower operating costs.

Some collapsible cargo containers for aircraft are known in the prior art. For example, U.S. Pat. No. 5,279,437, which issued to Kupersmit on Jan. 18, 1994, relates to a collapsible cargo container for aircraft. In an erected position, the container roof is supported above a pallet base by a plurality of wall panels. One shortcoming of the Kupersmit container is that the wall panels are constructed from a relatively rigid foldable material, such as corrugated fiberboard, plastics or aluminum. Such materials are relatively heavy. Another shortcoming is that the roof is interconnected at its peripheral edges to the wall panels which limits the manner in which the container will collapse.

U.S. Pat. No. 3,578,050, which issued to Weingarten et al. on May 11, 1971, also discloses a collapsible air cargo container. The Weingarten container has a rigid pallet base and flexible walls. The container walls are inflated for supporting the container in an upright, expanded position and are deflated when the container is returned empty to the place of origin without a load. Several knocked-down containers can be shipped in the space ordinarily occupied by a conventional container of the rigid and non-collapsible type. However, a fundamental drawback to the Weingarten design is that the container will not function as intended if the container walls are punctured or torn during cargo handling.

The need has therefore arisen for a light weight, collapsible airline container which overcomes the various limitations of the prior art.

SUMMARY OF THE INVENTION

A collapsible cargo container is disclosed comprising a base; a plurality of support posts each having a first end and a second end; a plurality of fasteners for operatively coupling the first end of each of the support posts to the base, wherein each support post is movable between an extended position extending upwardly from the base and a folded position extending in a plane parallel to the base; and a roof slidably coupled to the support posts and moveable between a deployed position and a collapsed position, wherein the roof is releasably connectable to the second end of each of the support posts in the deployed position. The roof has a plurality of apertures formed therein which are each sized to allow a corresponding support post to pass therethrough. This permits the roof to slide substantially along the length of the support posts between the deployed and the collapsed positions when the support posts are in the extended position.

The cargo container also includes flexible wall panels extending between the roof and the base. Preferably the roof and the base are constructed from a rigid material, such as sheets of aluminum certified for aeronautical use, and the wall panels are constructed from light weight fabric. The wall panels may include an outer web of adjustable straps which are releasably connectable to the base and to adjacent panels.

The fasteners preferably comprises a plurality of sleeves extending upwardly from the base for receiving the first end of the support posts in the extended position. The support posts are slidably and pivotably secured to the sleeves with a bayonet coupling. The bayonet coupling permits the support posts to pivot to a folded position resting on an upper surface of the roof (after the roof has been slid to the collapsed position). Preferably the sleeves each comprise a bracket for supporting the roof in a horizontal orientation a short distance above the base in the collapsed position. In the collapsed position, the flexible wall panels are stowed between the base and the roof.

The surface area of the roof is preferably larger than the base. The container may also optionally include a pallet extension pivotably coupled to the base and moveable between a deployed position and a collapsed position. In the deployed position, the pallet extension extends outwardly of the base beneath the roof at one end of the container. In the collapsed position, the pallet extension folds onto the upper surface of the container base. The pallet extension includes a base and a pair of support arms hingedly coupled thereto. The support arms extend between the pallet extension base and the overlying roof in the deployed position. A support assembly extends between the container base and the pallet extension base for supporting the pallet extension base in a horizontal plane parallel to the container base and the roof. At least one flexible wall panel extends between the pallet extension base and the container roof.

The container may also include locking means for releasably coupling the roof to the support posts and the pallet extension support arms in the deployed position. The locking means may comprise spring-loaded pins secured to the undersurface of the roof which are slidable into apertures formed in the second, upper ends of the support posts and support arms when the roof is slid to the deployed position. In the collapsed position, the height of the container is between about 15–20% of the height of said container in the deployed position.

BRIEF DESCRIPTION OF THE DRAWINGS

In drawings which illustrate a preferred embodiment of the invention, but which should not be construed as restricting the spirit or scope of the invention in any way.

DETAILED DESCRIPTION OF THE PREFERRED EMBODIMENT

Figure 1:
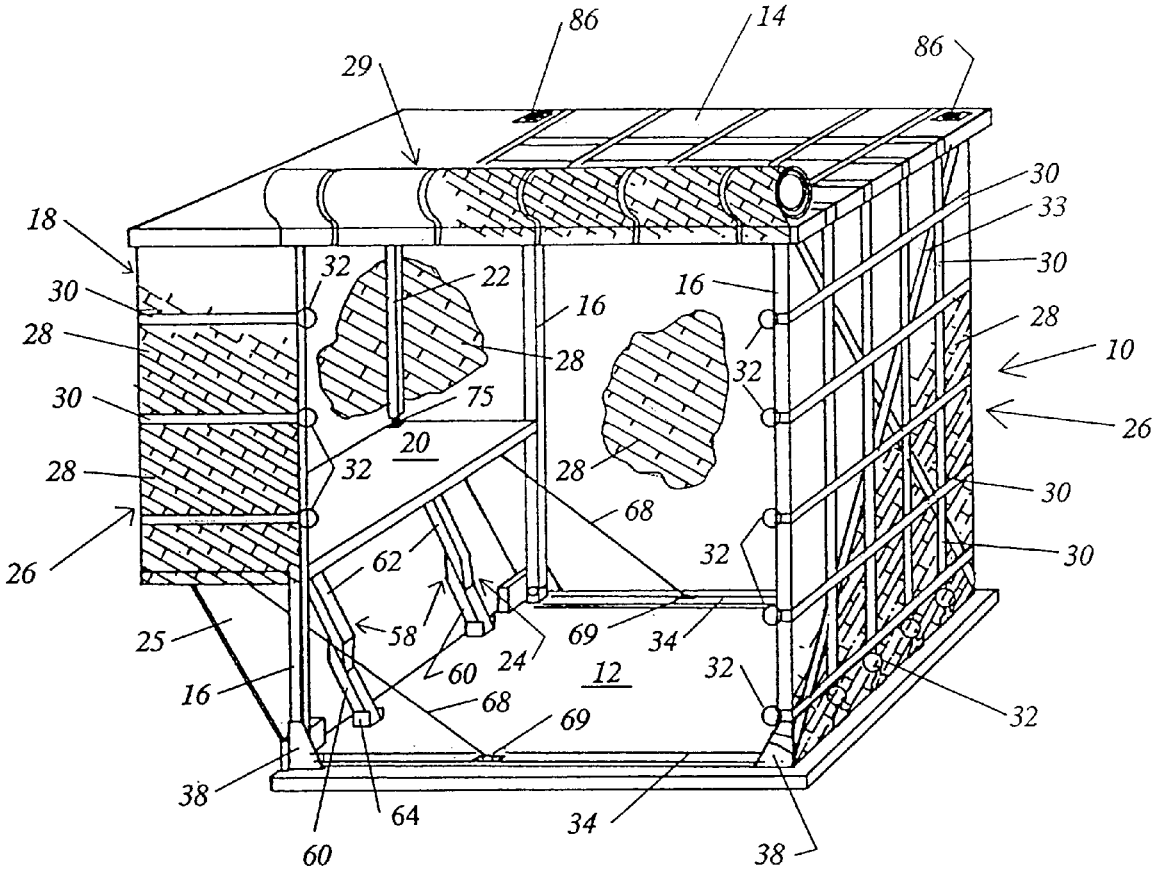
FIG. 1 is an isometric view of a first embodiment of the applicant's cargo container in an erected position.
Figure 2:
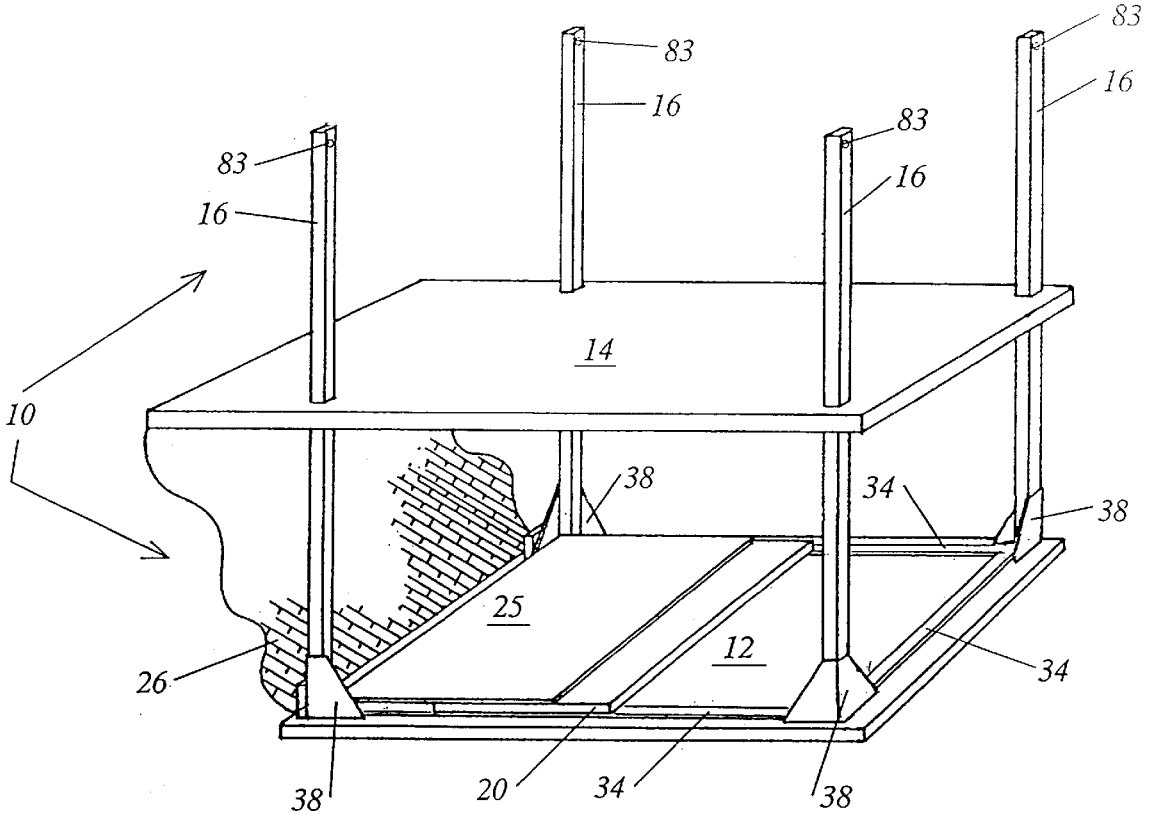
FIG. 2 is an isometric view of the container of FIG. 1 in a semi-collapsed position.
Figure 3:
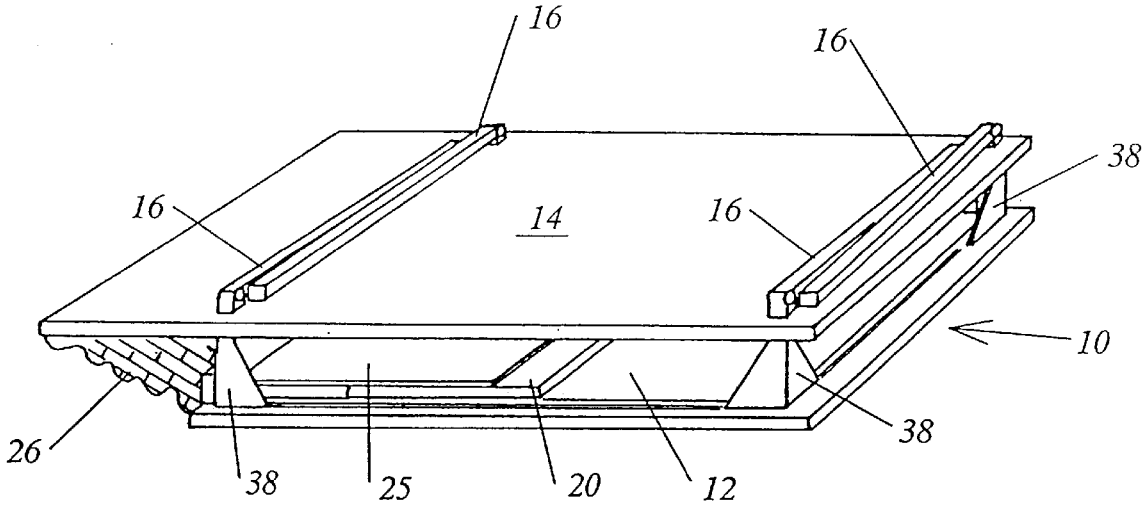
FIG. 3 is an isometric view of the container of FIG. 1 in a fully collapsed position.

This application relates to a collapsible airline cargo container 10. As shown in FIGS. 1–3, container 10 is adjustable between erected, semi-collapsed and fully collapsed positions.

Container 10 includes a pallet base 12 and a roof 14 which are preferably constructed from sheets of aluminum certified for aeronautical use. In the embodiment illustrated in the drawings, roof 14 has a larger surface area than base 12.

In the erected position, roof 14 is supported by a plurality of foldable support posts 16 which extend upwardly from the four corners of base 12. Roof 14 has apertures 17 (FIG. 19) formed therein for receiving posts 16. As shown best in FIG. 2, this permits roof 14 to slide vertically relative to support post 16 between the erected and the collapsed positions. Roof 14 is releasably coupled to the upper end of support posts 16 in the erected position as described further below.

As shown in FIG. 1, container 10 may optionally include an outboard wing or "pallet extension" generally designated 18. Pallet extension 18 extends outwardly of container base 12 so that container 10 assumes a "LD3" unit load device configuration to conform to the dimensions of below-deck cargo holds in some aircraft. Pallet extension 18 includes a base 20 and a pair of foldable support arms 22. In the erected position, base 20 extends in a horizontal plane between container base 12 and roof 14, and support arms 22 extend upwardly from the outer corners of base 20 to support corner portions of container roof 14. Pallet extension base 20 is supported in the erected position by a support assembly 24 which is hingedly connected to container base 12 as described in further detail below.

In the embodiment of the invention shown in FIG. 1, pallet extension 18 may also include a skirt 25 extending between container base 12 and pallet extension base 20 at the outboard end of container 10. Skirt 25 may comprise a sheet of aluminum or fabric which acts as a barrier preventing cargo from falling out of container 10 at its outboard end. In the semi-collapsed and fully collapsed positions shown in FIGS. 2 and 3, skirt 25 preferably folds on top of pallet extension base 20 and extends in a horizontal plane parallel to container base 12.

Container 10 further includes light weight, flexible walls 26 extending between container base 12 and roof 14. Walls 26 also extend between pallet extension base 20 and roof 14 at the outboard end of container 10. Walls 26 are preferably constructed from panels 28 of fabric, such as flame retardant, rip-resistant polyurethane weave. Walls 26 may also include a web of adjustable straps 30 overlying fabric panels 28 to confer enhanced structural rigidity and support.

Figure 4:
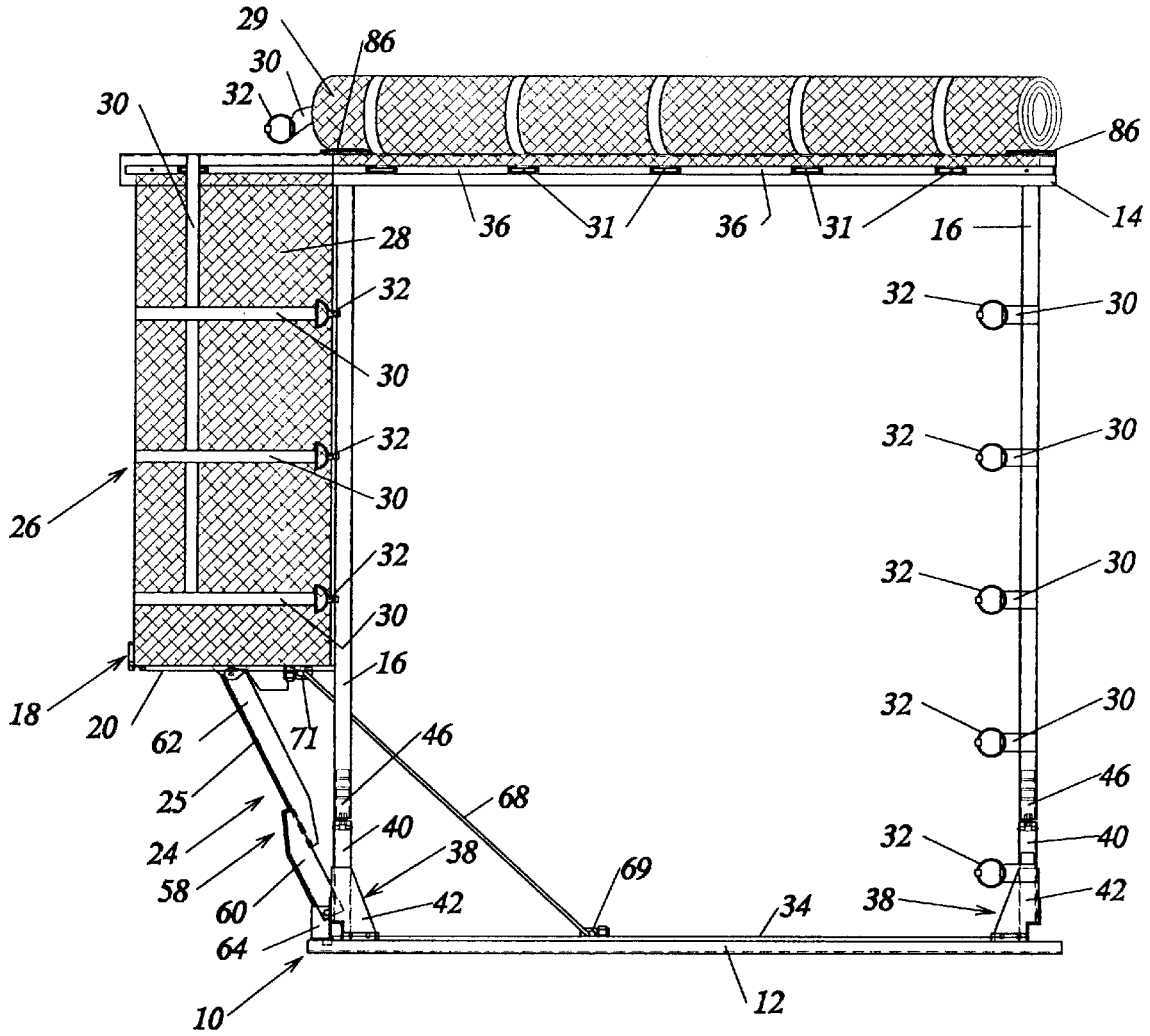
FIG. 4 is a side elevational view of a second embodiment of the applicant's cargo container in an erected position.
Figure 5:
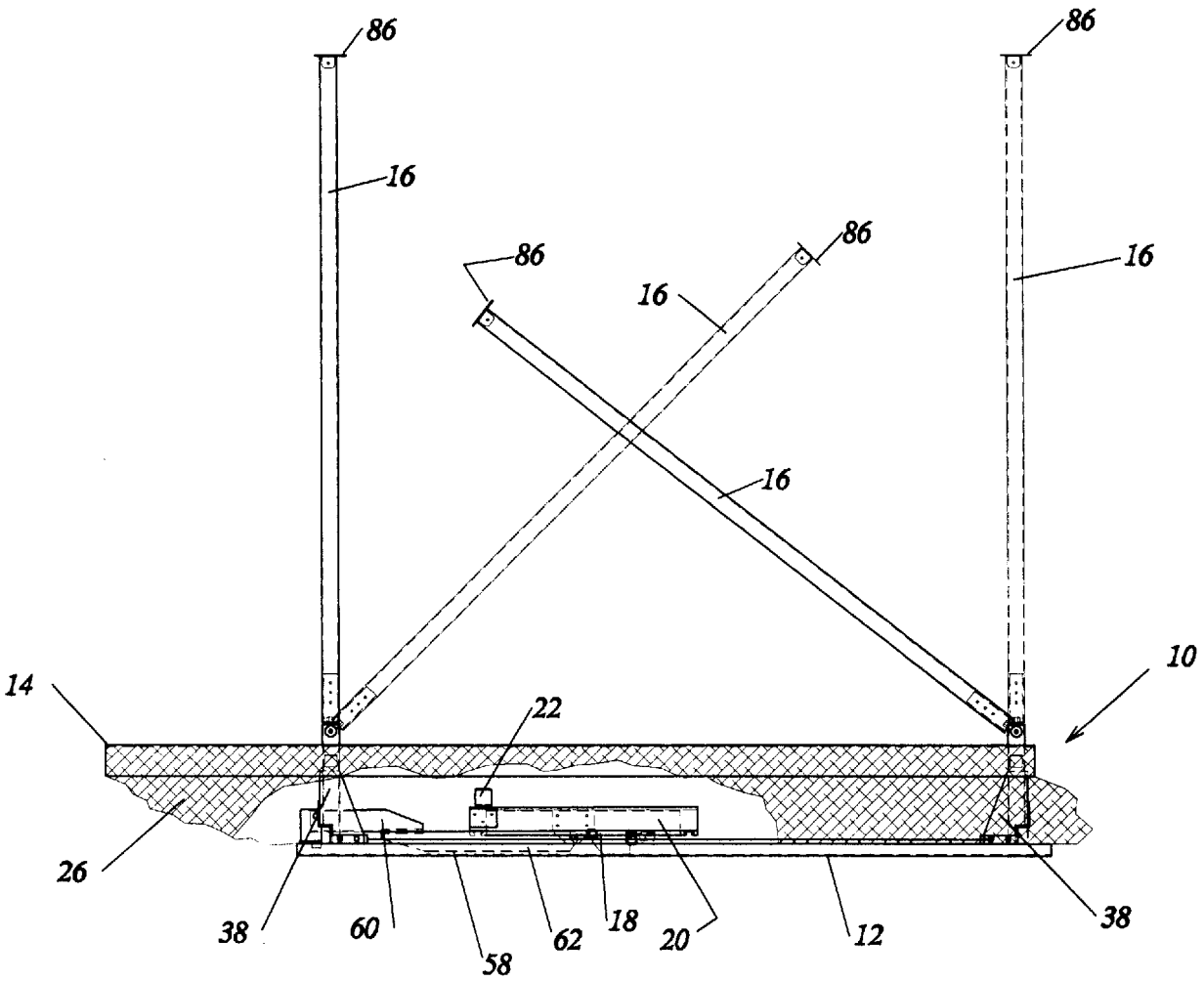
FIG. 5 is a side elevational view of the container of FIG. 4 in a semi-collapsed container illustrating the pivoting support posts.

In the embodiments illustrated in the drawings, walls 26 are constructed from four separate fabric panels 28. This facilitates ease of repair if only one of the panels 28 is damaged during cargo handling. The fabric panel 28 at the forward end of container 10 comprises a door 29 which may be rolled up and placed on roof 14 during loading or unloading of container 10 (FIGS. 1 and 4). As should be apparent to someone skilled in the art, cargo could also be loaded or unloaded through the rear or sides of container 10 in alternative embodiments of the invention if desired.

Figure 7:
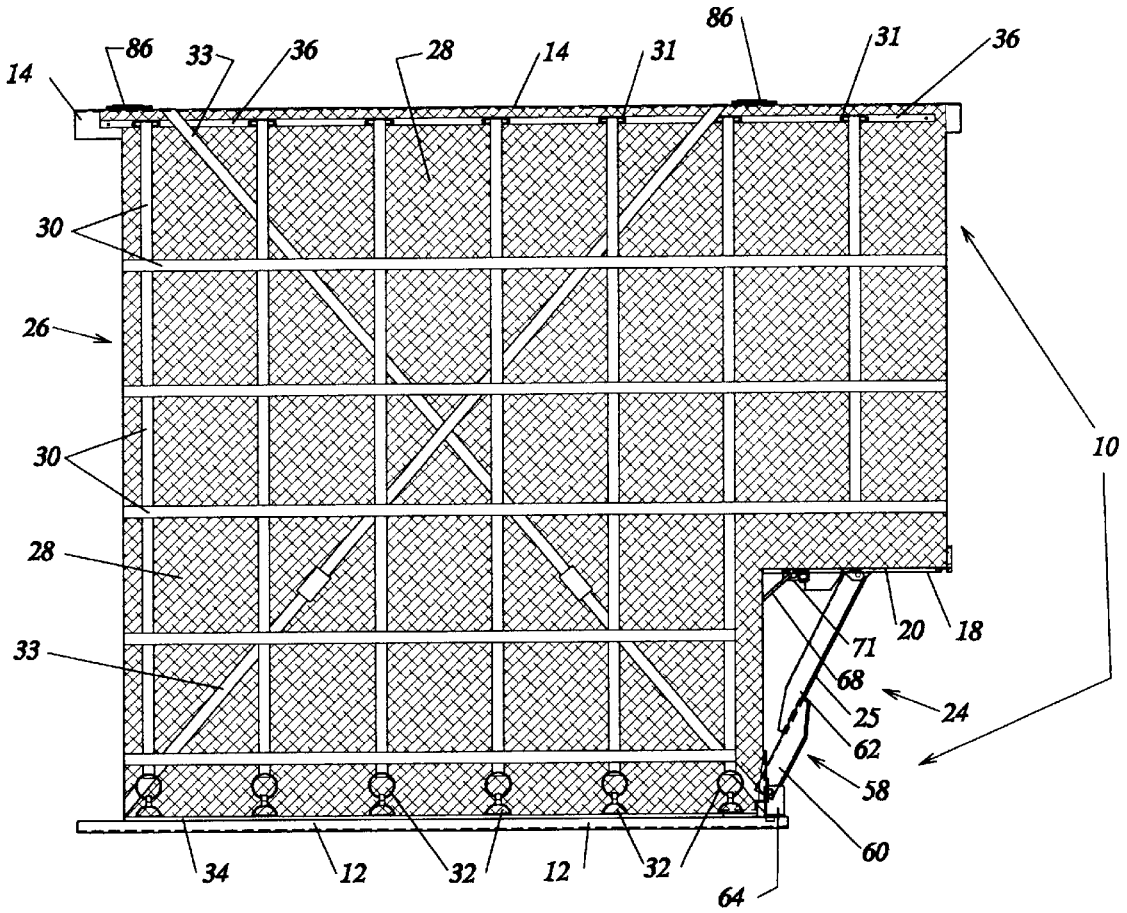
FIG. 7 is a rear elevational view of the container of FIG. 4.

As shown best in FIGS. 4 and 7, panels 28 are preferably secured to base 12 and roof 14 with an elongated fabric restrainer strip 36 (except for the base of door 29). The upper and lower edges of panels 28 are wrapped around a restraining strip 36 and held in place with releasable fasteners 31 which extend through the restraining strip 36 into a supporting structure on the base 12 or roof 14. Fasteners 31 may be readily removed if it is necessary to completely detach a panel 28 from container 10 for repair or storage. In normal use, restraining strips 36 remain fixed in place and panels 28 are not detached.

The vertical edges of panels 28, except for door 29, are preferably fastened to adjacent support posts 16 with strips of hook and loop-type fasteners, such as VELCRO™ (not shown). The hook-type fastener preferably extends along the length of each support post 16. An end portion of each panel 28 is wrapped part-way around an adjacent post 16 in the erected position to tension wall 26 and help provide a weather-proof seal.

As indicated above, a web of adjustable straps 30 overlies panels 28 to form the outer portion of flexible walls 26.

Figure 19:
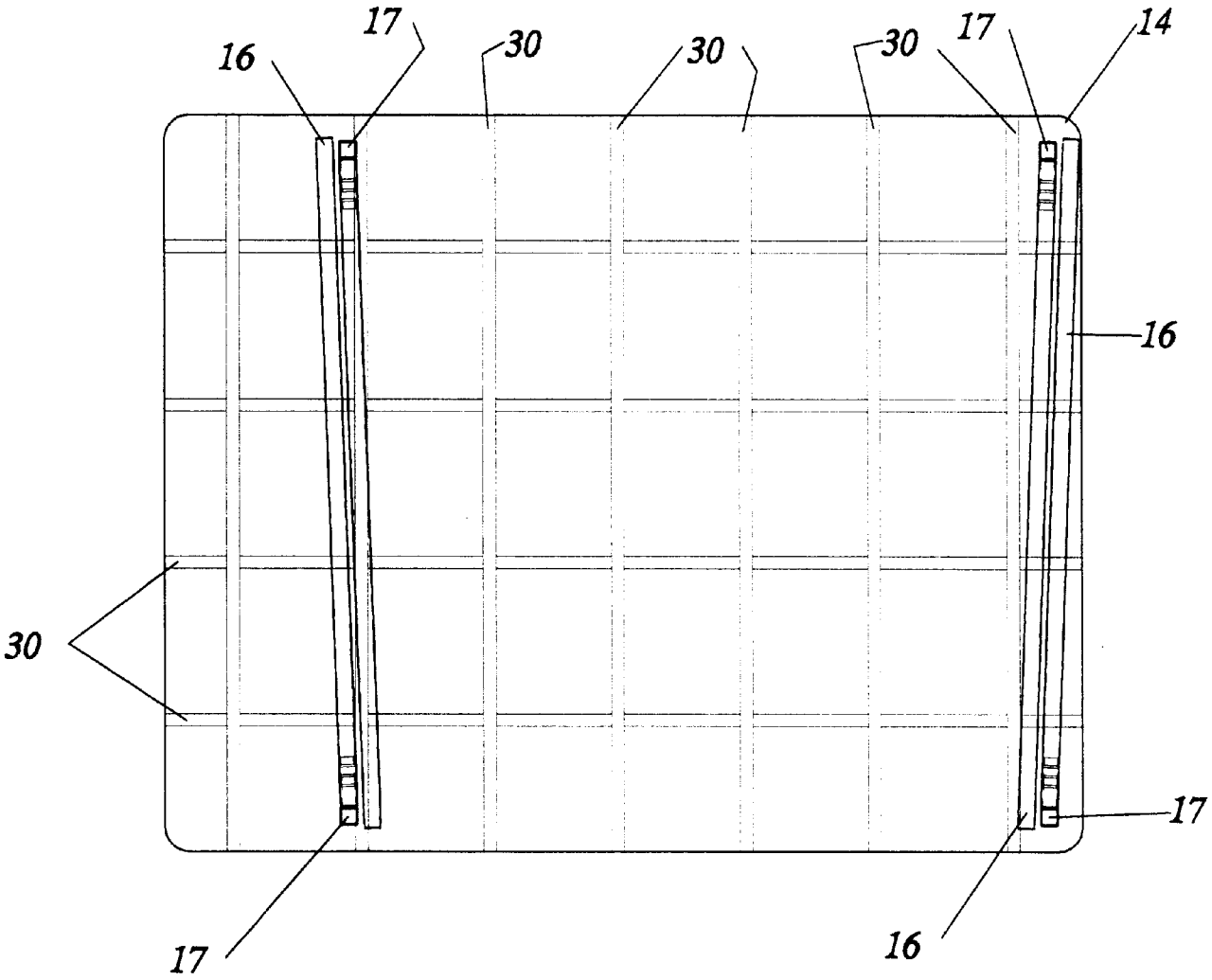
FIG. 19 is plan view of the applicant's container in a fully collapsed position showing the support posts folded on to the upper surface of the container roof.

Straps 30 provide sufficient structural support to ensure container 10 will be certified for flight. In one embodiment of the invention, straps 30 may extend over roof 14 (FIG. 19). Cross member straps 33 may be provided on the rear and inboard walls of container 10 (FIG. 8) for additional support.

Figure 11:
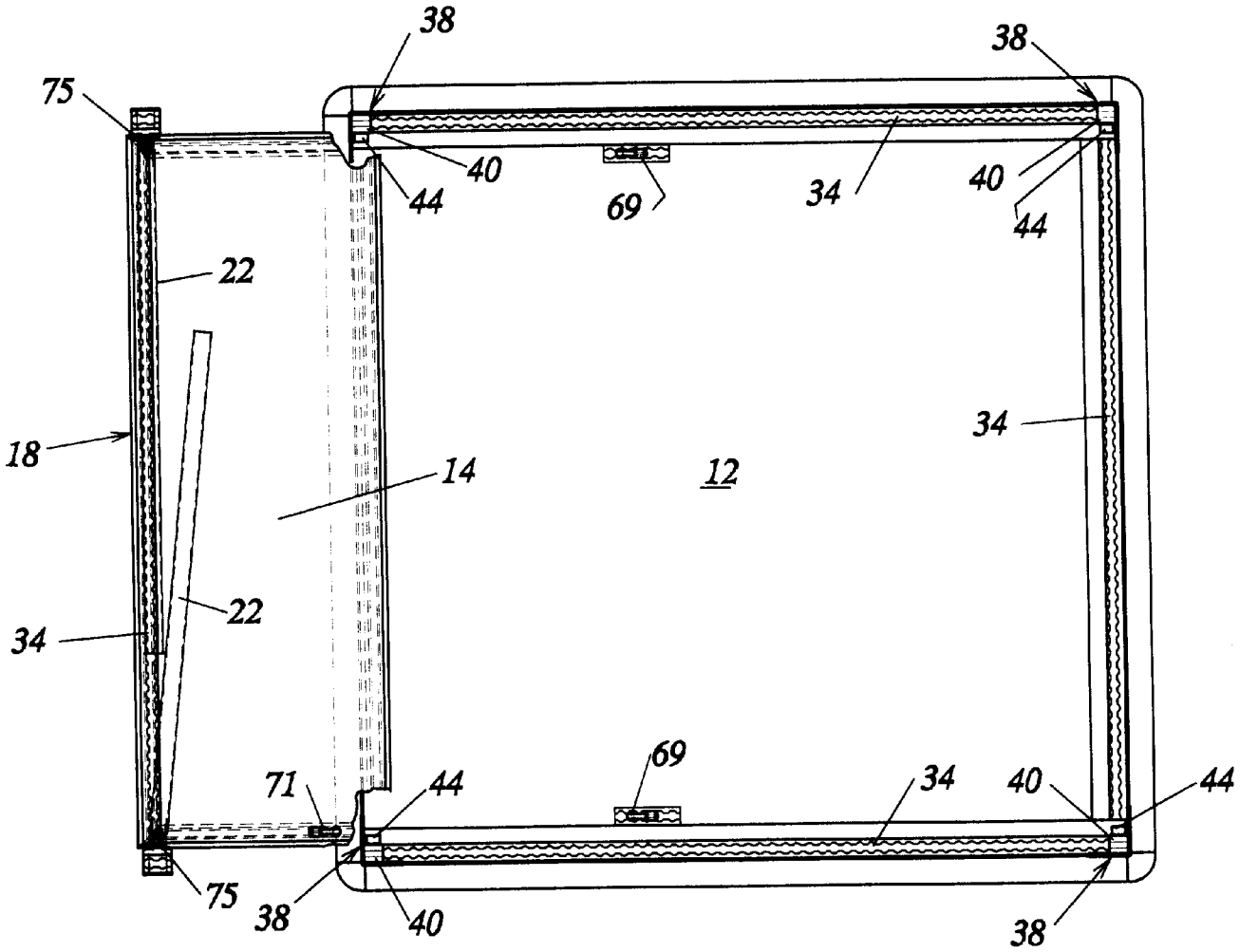
FIG. 11 is a top, plan, partially cut-away view of the container of FIG. 4.

Clasps 32 are mounted at the ends of straps 30 for releasably fastening the bottom edge of walls 26 (including front door 29) to a hold-down track 34 which extends around the perimeter of container base 12 (FIG. 11). Track 34 is preferably welded to base 12. Clasps 32 may be secured to track 34 anywhere along its length. As shown best in FIGS. 1 and 4, clasps 32 are also used to secure the vertical edges of door 29 to adjacent inboard and outboard walls 26 after container 10 has been loaded. Straps 30 are then cinched tight.

Figure 12:
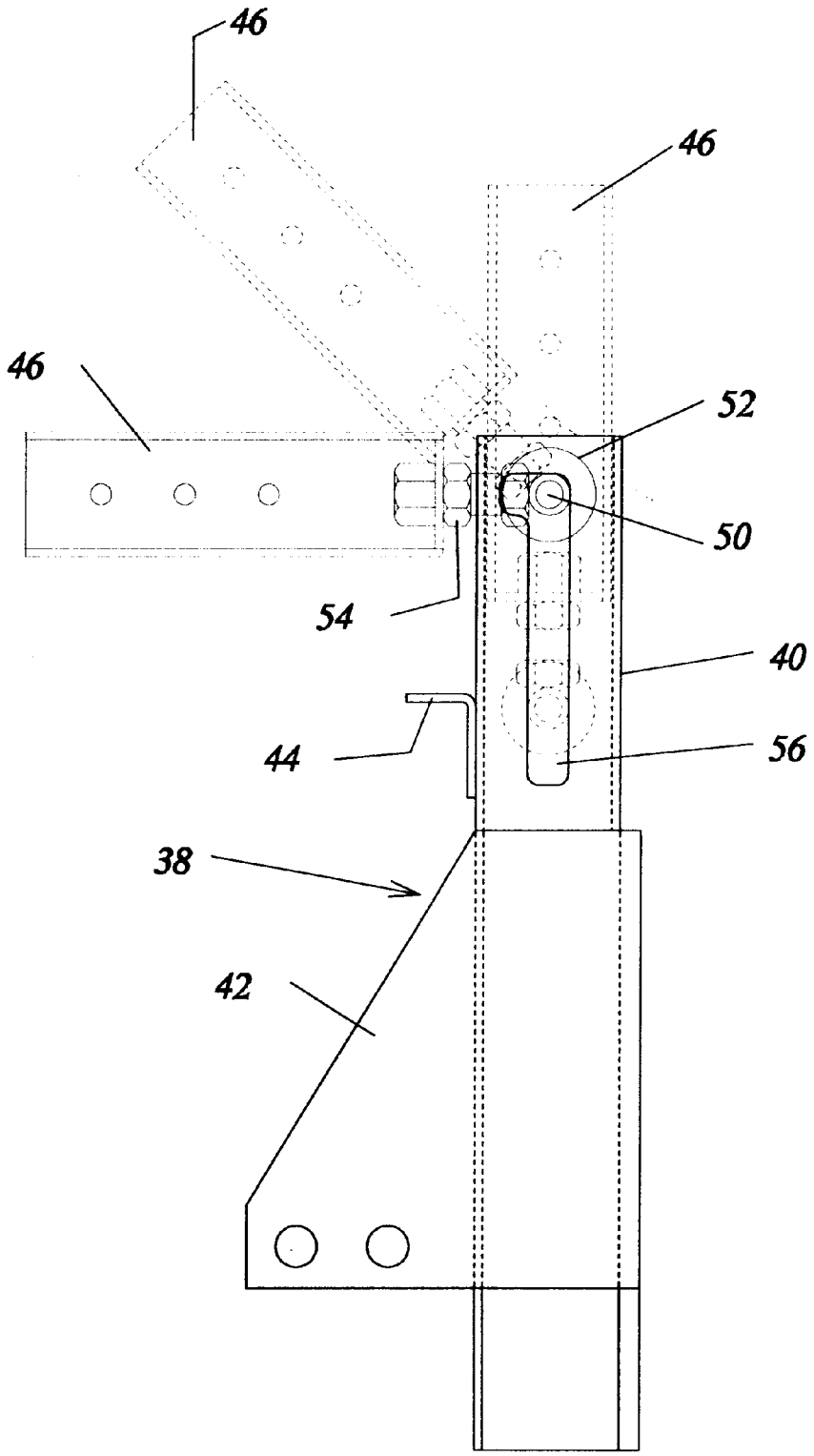
FIG. 12 is an enlarged, end elevational view of a post support and bayonet coupling showing different positions of a support post insert in dotted outline.
Figure 14:
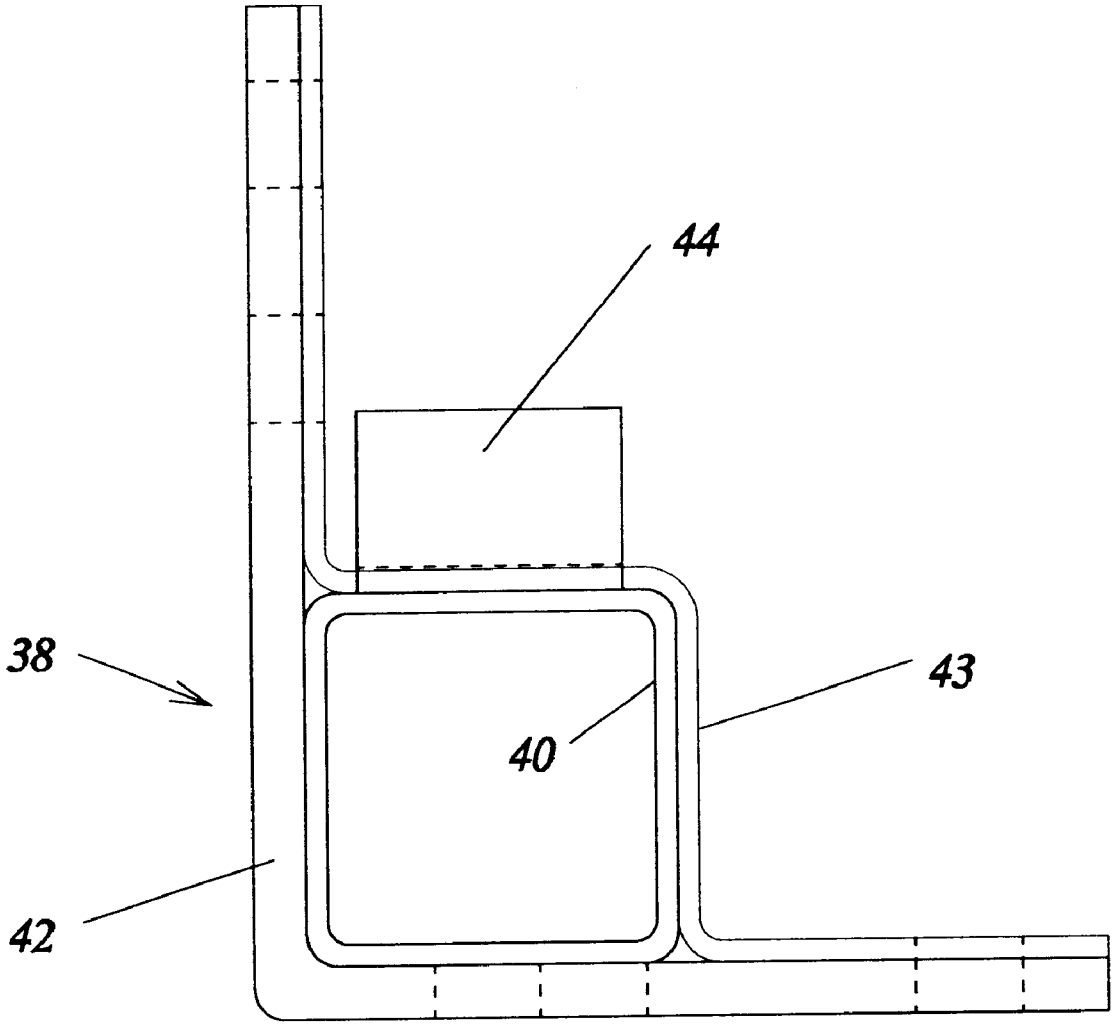
FIG. 14 is a top, plan partially exploded view of a post support.

As shown best in FIGS. 12 and 14, a post support 38 is mounted at each corner of container base 12 for pivotably coupling a corresponding support post 16 to base 12. Post support 38 includes an upright sleeve 40 which is preferably braced by an L-shaped outer gusset 42 and inner gusset 43 (FIG. 14). A bracket 44 is mounted near the upper end of each sleeve 40 for supporting roof 14 a short distance above container base 12 when container 10 is in the fully collapsed position (FIG. 3).

Figure 13A:
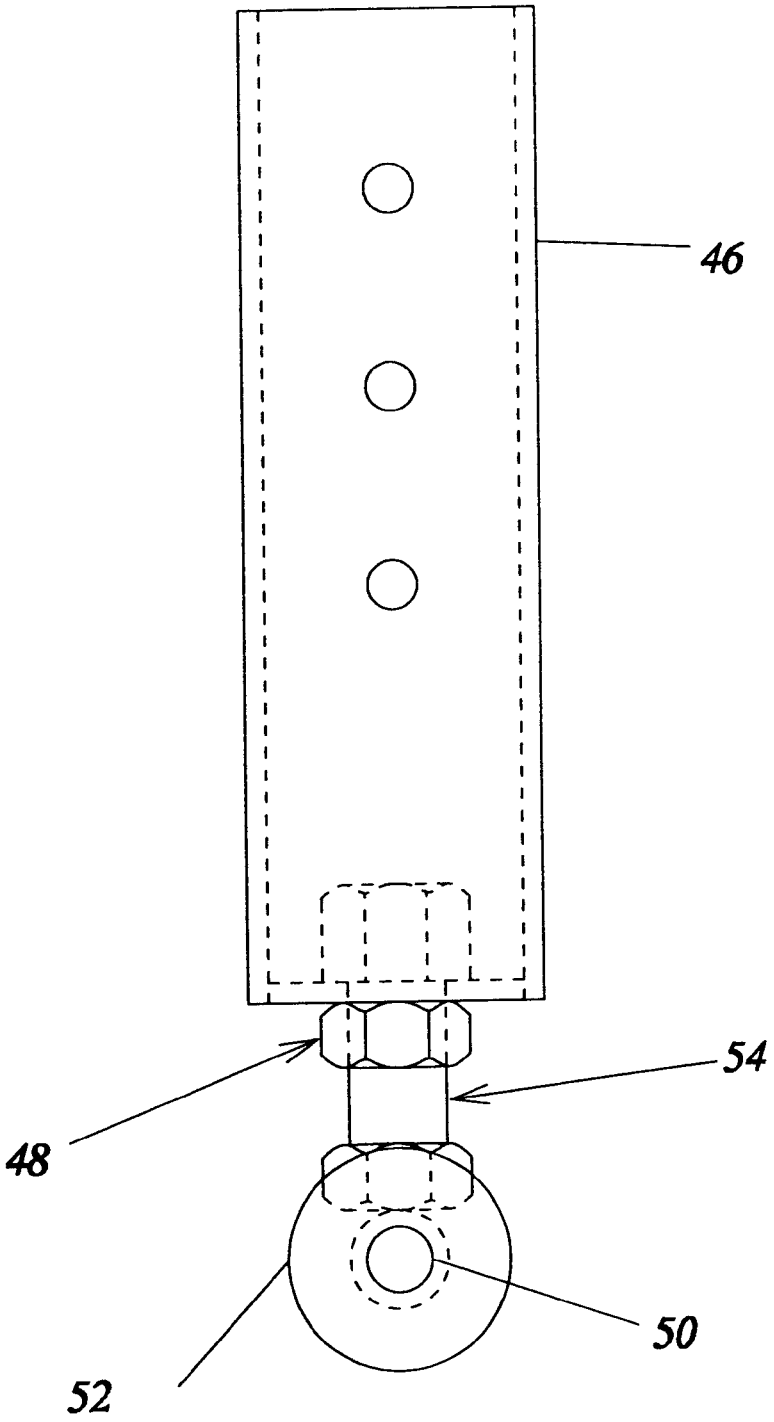
FIG. 13A is an enlarged, end elevational view of a support post insert with a bayonet pin assembly at its lower end.
Figure 13B:
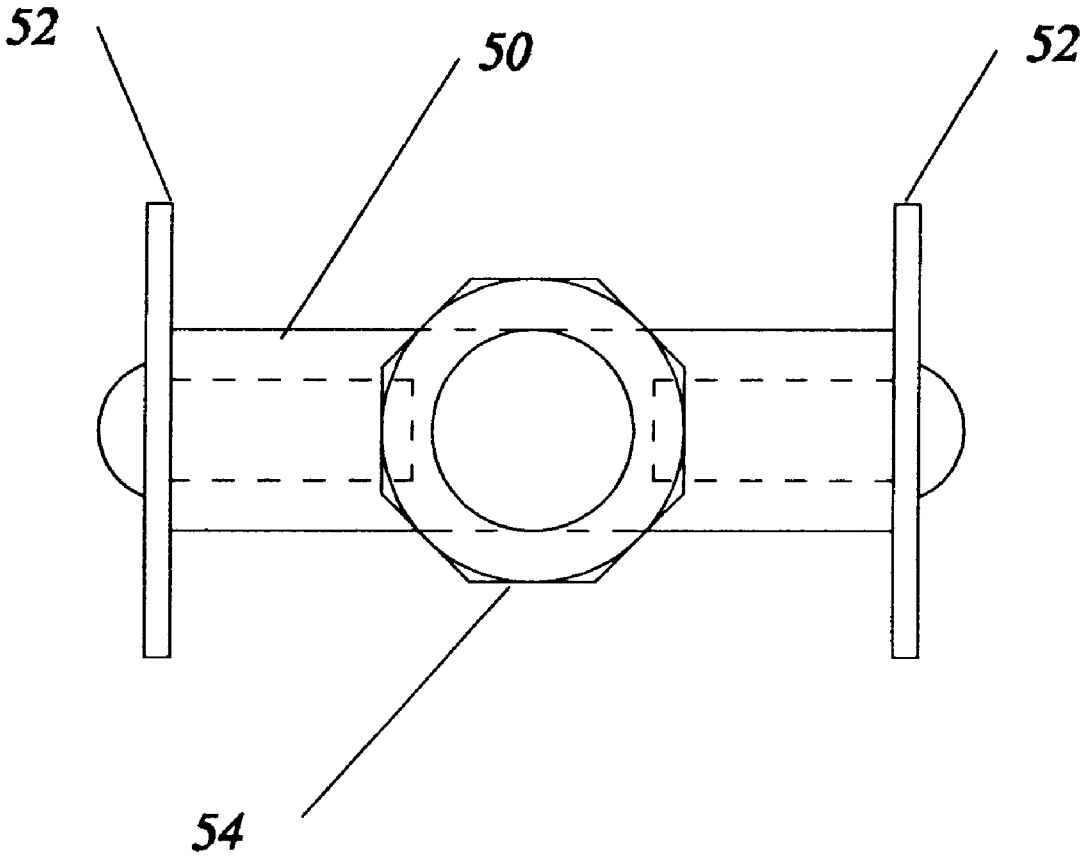
FIG. 13B is an enlarged, side elevational view of the bayonet pin assembly of FIG. 13A.

In the preferred embodiment, each support post 16 is pivotally secured to a post support 38 by means of a bayonet coupling. More particularly, each support post 16 has a leg insert 46 at its lower end which includes a bayonet pin assembly 48 (FIG. 13A). Assembly 48 includes a pin 50 which extends transversely between a pair of circular end plates 52 (FIG. 13B). Pin 50 is coupled to the lower end of insert 46 with a bolt and nut assembly 54.

Figure 10:
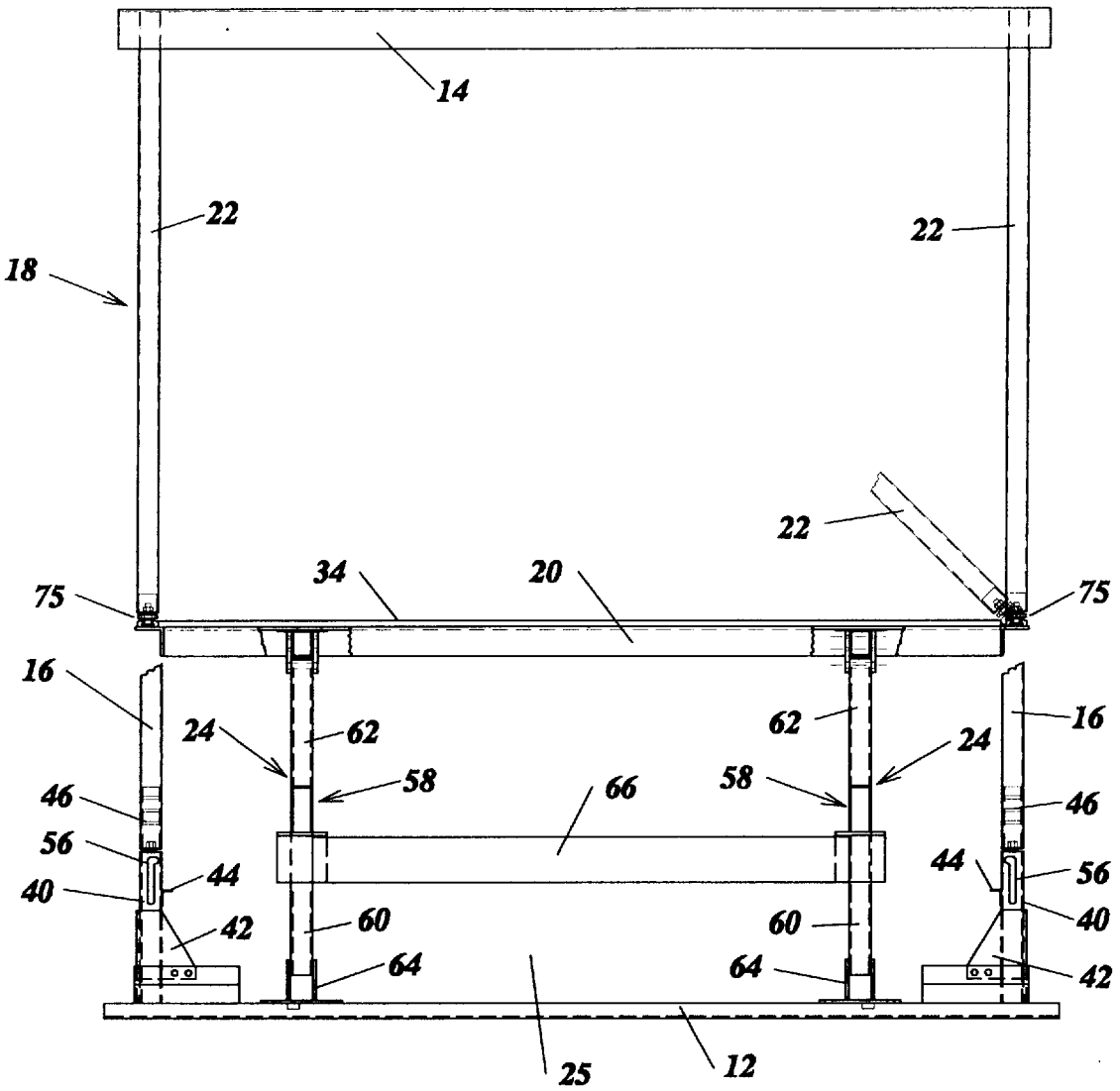
FIG. 10 is and end elevational, partially cut-away view of the container of FIG. 4.

Inverted J-shaped bayonet slots 56 are formed on opposed end surfaces of each sleeve 40 for slidably receiving a pin assembly 48 (FIGS. 10 and 12). When leg insert 46 and sleeve 40 are vertically aligned, pin assembly 48 can slide downwardly in slots 56 until insert 46 is securely captured within sleeve 40 (shown in dotted outline in FIG. 12). In this position, each support post 16 is held rigidly upright relative to a corresponding post support 38 and pivoting motion of the support post 16 is restrained.

In order to fold support posts 16 to a collapsed position, insert 46 is slid upwardly until pin assembly 48 reaches the top end of slots 56 (shown in solid outline in FIG. 12). At this position, insert 46 is clear of sleeve 40 and pin 50 is free to rotate. Support posts 16 can then be folded downwardly to rest flush with the upper surface of container roof 14 (FIG. 19). As explained above, the undersurface of roof 14 is supported by brackets 44 in the collapsed position.

Figure 8:
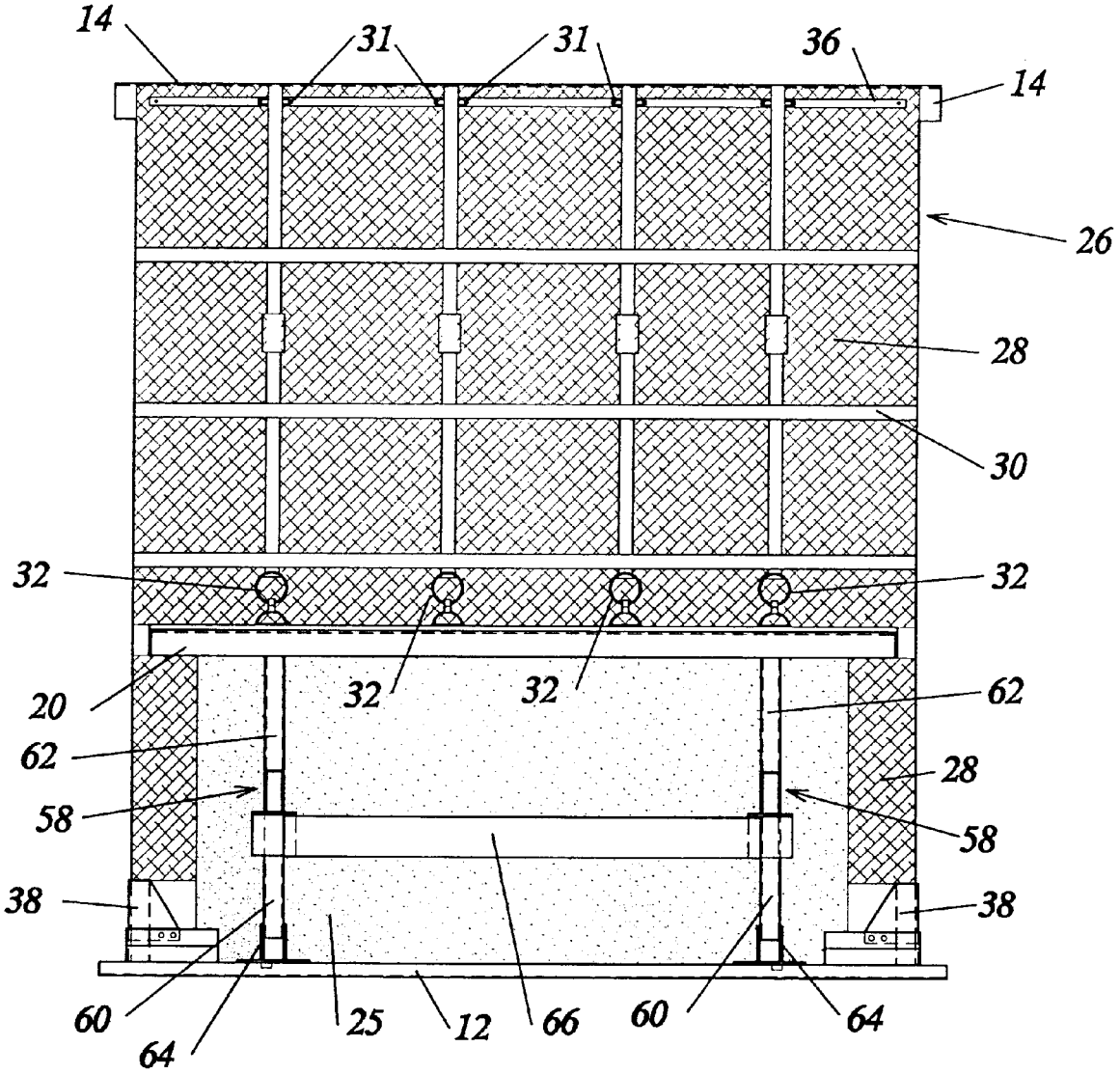
FIG. 8 is an end elevational view of the container of FIG. 4.
Figure 9:
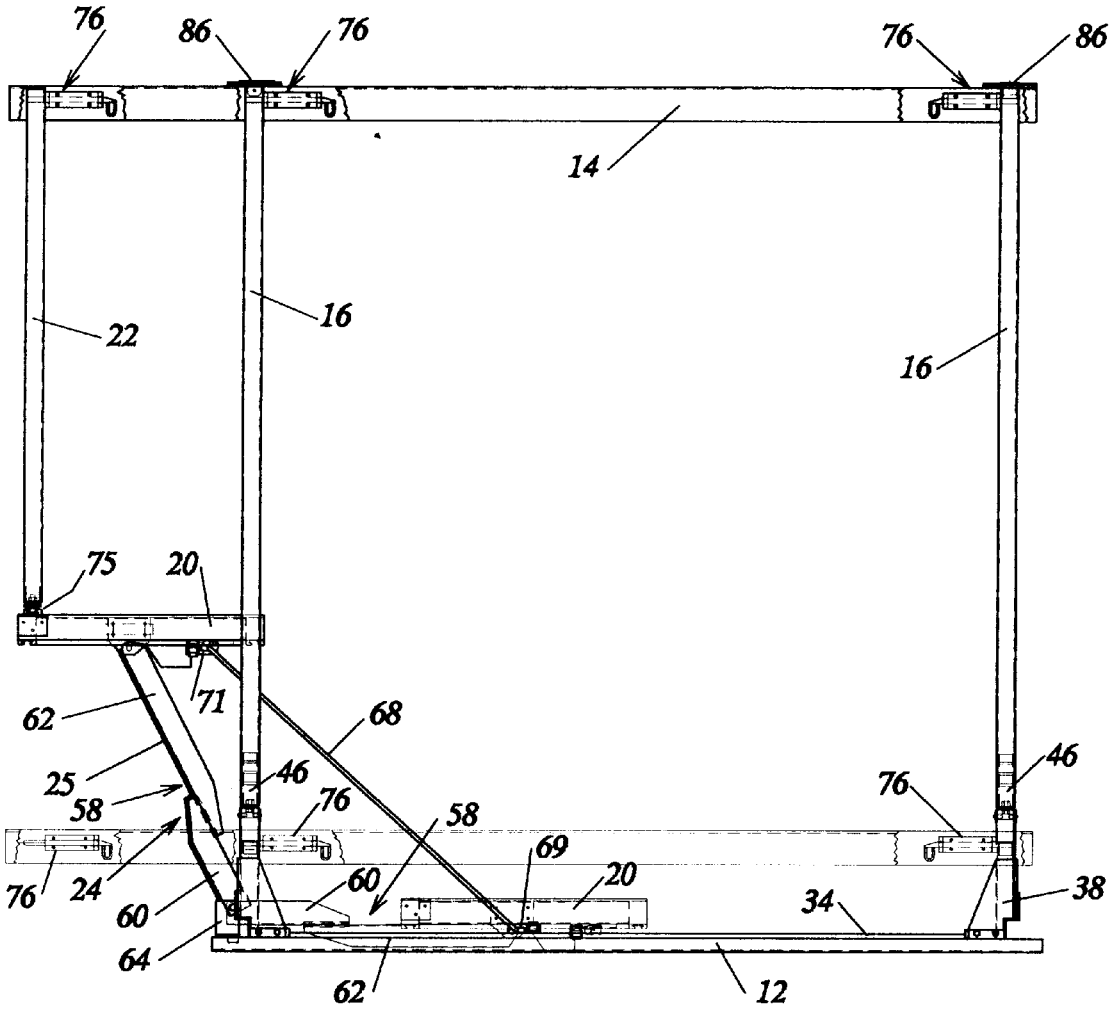
FIG. 9 is a side elevational, partially cut-away view of the container of FIG. 4 showing the position of the roof in the fully collapsed position in dotted outline.

Pallet extension support assembly 24 is also foldable to a collapsed position, as shown in dotted outline in FIG. 9. Assembly 24 includes a pair of braces 58, each comprising a lower member 60 and an upper member 62. As shown best in FIGS. 1 and 8, each brace lower member 60 is hingedly coupled to an anchor 64 projecting upwardly from container base 12 at its outboard end. A crosspiece 66 may extend between respective lower members 60 for enhanced structural support (FIGS. 8 and 10).

Brace upper member 62 is rigidly connected to a respective lower member 60 in an offset position. This ensures that, when braces 58 are folded to the collapsed position, upper member 62 will rest flush on the upper surface of base 12 and lower member 60 will clear a narrow rail (not shown) which may project upwardly from base 12 around the periphery thereof (including at the outboard end).

The uppermost end of each brace upper member 62 is pivotally connected to the undersurface of pallet extension base 20 at an end portion thereof (FIGS. 7 and 9). In one embodiment of the invention, support cables 68 may be provided for restraining pivoting motion of base 20 in the deployed position shown in FIG. 1. The lower end of each cable 68 is secured to a respective bracket 69 mounted on container base 12. The upper end of each support cable 68 is fastened to a bracket 71 mounted on the undersurface of pallet extension base 20 to restrain pivoting motion thereof.

Figure 16A:
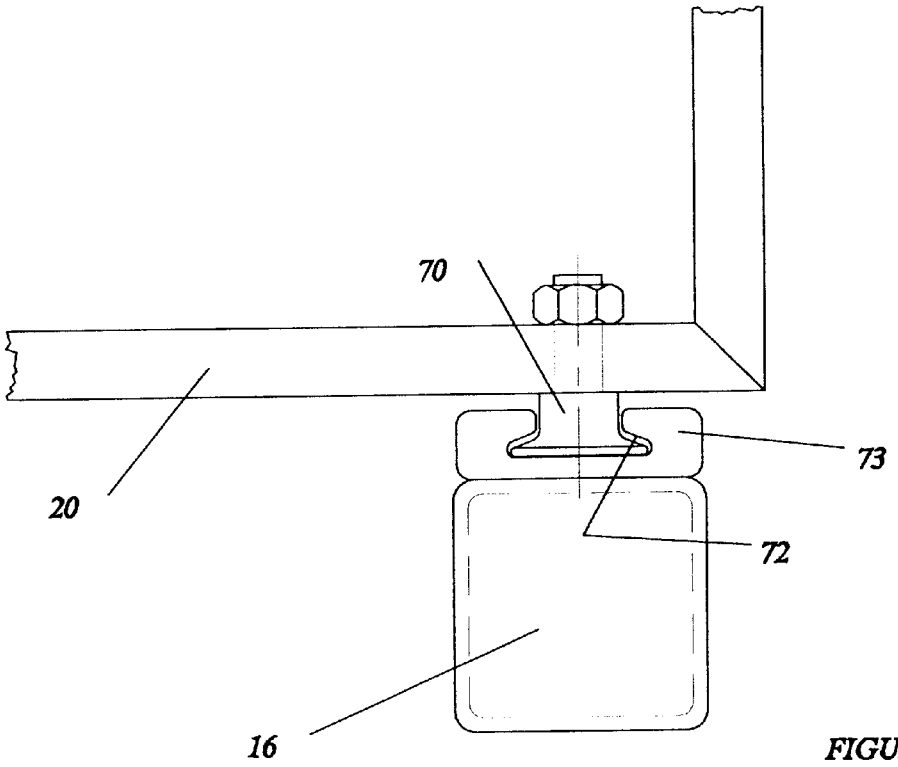
FIG. 16A is an enlarged, fragmented top plan view of a locking pin projecting from an end surface of the pallet extension base which is received in a slot formed in a shoe mounted on a support post.
Figure 16B:
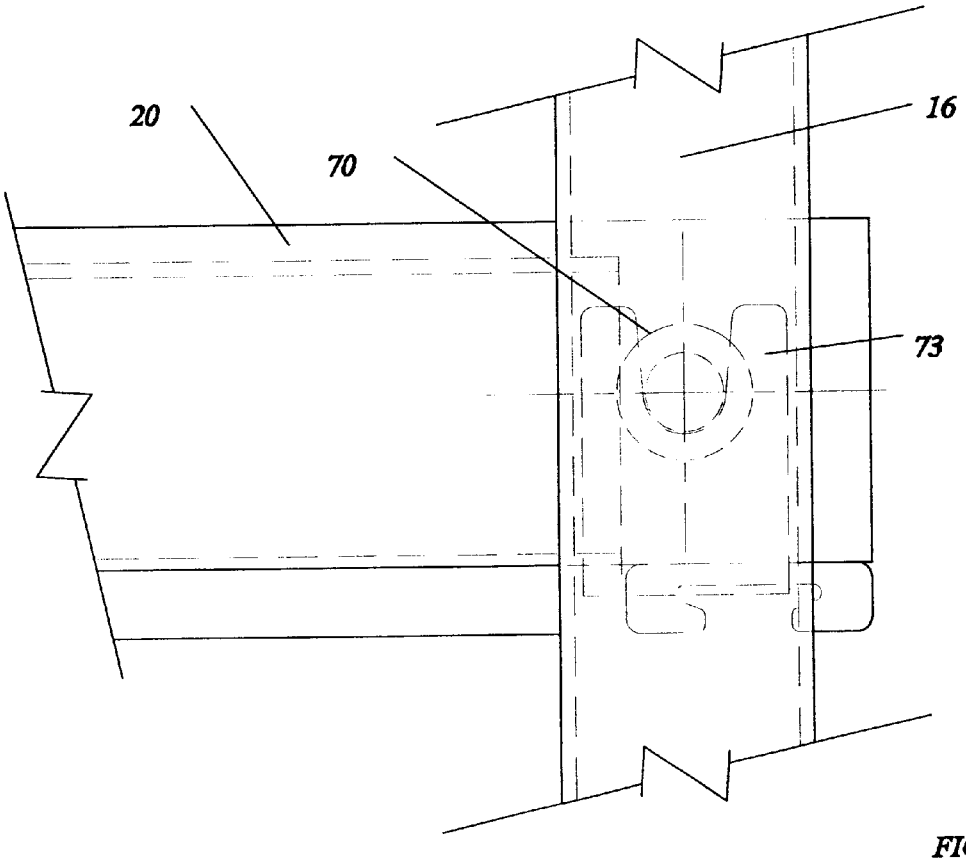
FIG. 16B is an enlarged, fragmented side elevational view of the pin and slot assembly of FIG. 16B.

In an alternative embodiment illustrated in FIGS. 16A and 16B, flared pins 70 may be mounted on the end walls of pallet extension base 20. When base 20 is pivoted to the horizontal, deployed position shown in FIG. 1, each pin 70 becomes seated in a slot 72 formed in a shoe 73 which is mounted on an inner face of support posts 16 at the outboard end of container 10. This engagement of pins 70 and shoes 73 ensures that pallet extension base 20 remains securely oriented in a horizontal plane in the deployed position.

Figure 6:
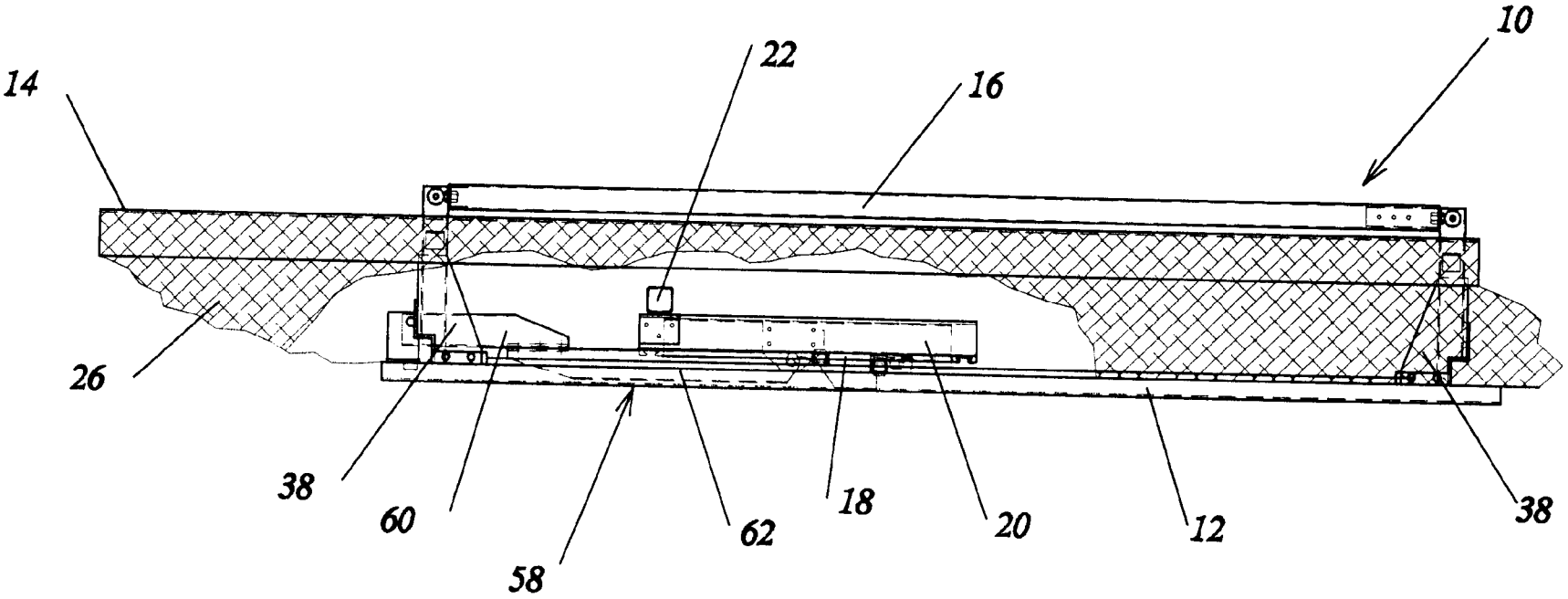
FIG. 6 is a side elevational view of the container of FIG. 4 in a fully collapsed position.

Pallet extension 18 may be collapsed by first disengaging support posts 22 from roof 14 and folding them downwardly about hinges 75 onto the upper surface of pallet extension base 20 (FIGS. 9–11). Support cables 68 are then disengaged from pallet extension base 20 and/or pins 70 are disengaged from mating shoes 73 as discussed above. The pallet extension support assembly 24 is then swung downwardly and inwardly to the collapsed position shown in FIG. 6 (and in dotted outline in FIG. 9) until brace upper members 62 come to rest on the upper surface of container base 12. Pallet extension base 20 is folded to a position on top of brace upper members 62, extending in a plane parallel to container base 12. Thus, in the fully collapsed position shown in FIGS. 6 and 9, pallet base 20 and support assembly 24 are compactly stowed between container base 12 and the overlying collapsed roof 14. As shown in FIG. 6, flexible container walls 26 are also stowed between base 12 and roof 14 in the fully collapsed position.

In the embodiment of the invention shown in FIGS. 1–3, skirt 25 folds on top of pallet extension base 20 in the collapsed position as described above.

Figure 15:
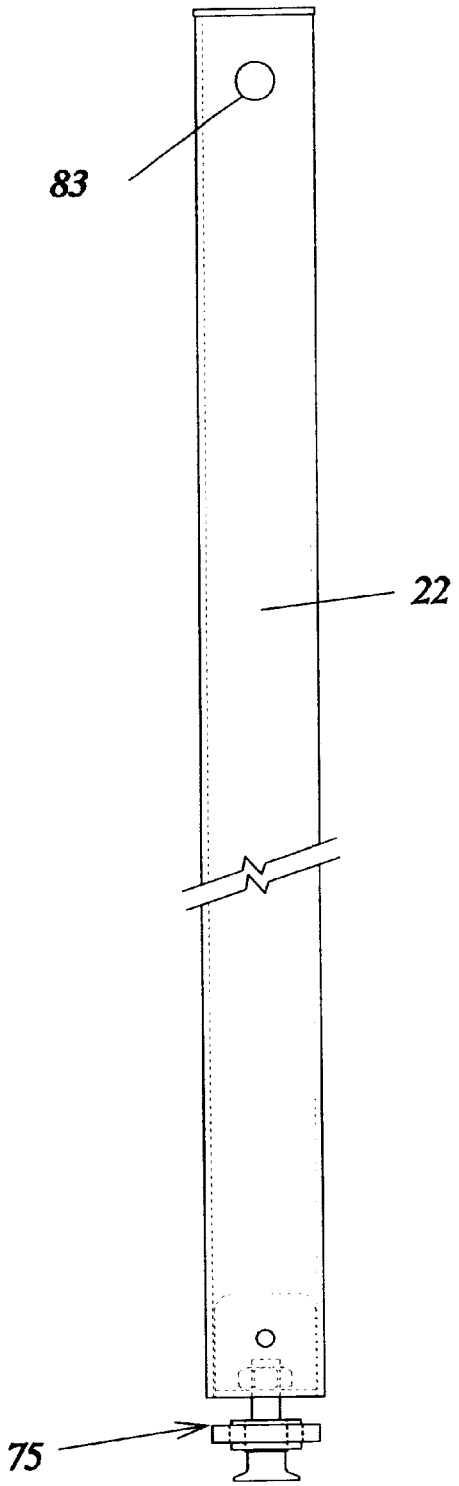
FIG. 15 is a fragmented, side elevational view of a pallet extension support arm.
Figure 17:
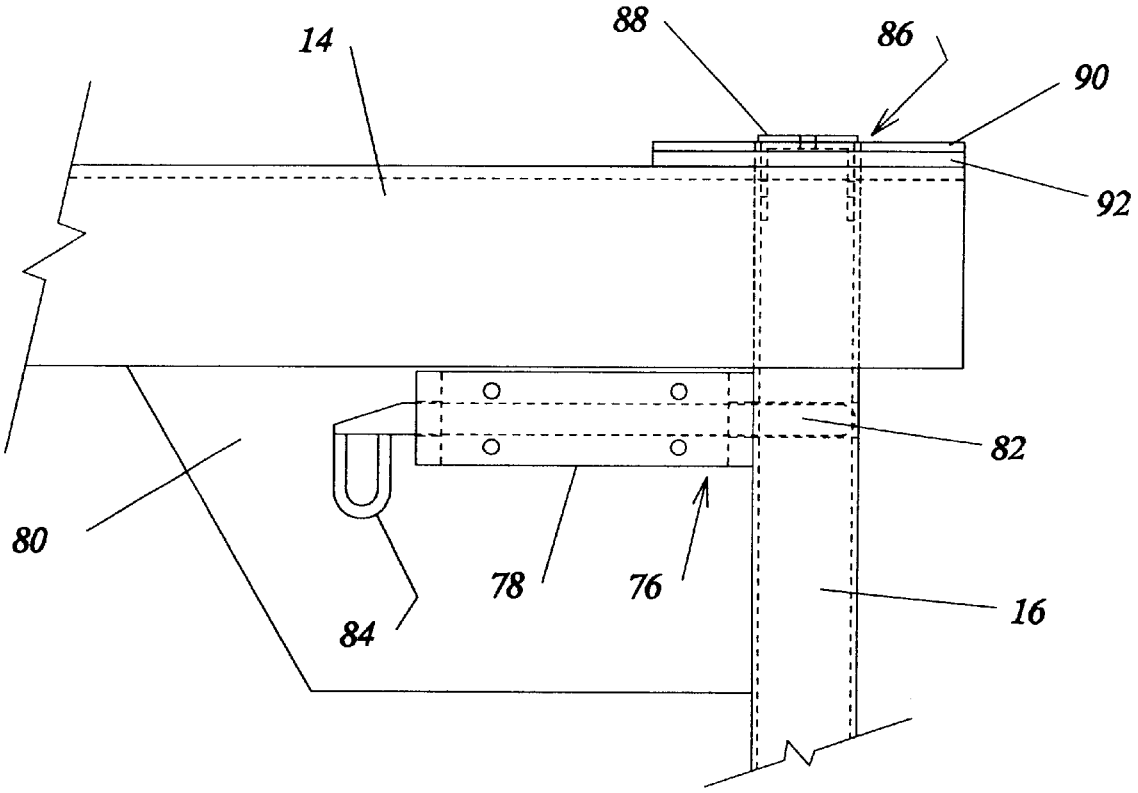
FIG. 17 is an enlarged, fragmented side elevational view of a roof locking assembly.
Figure 18:
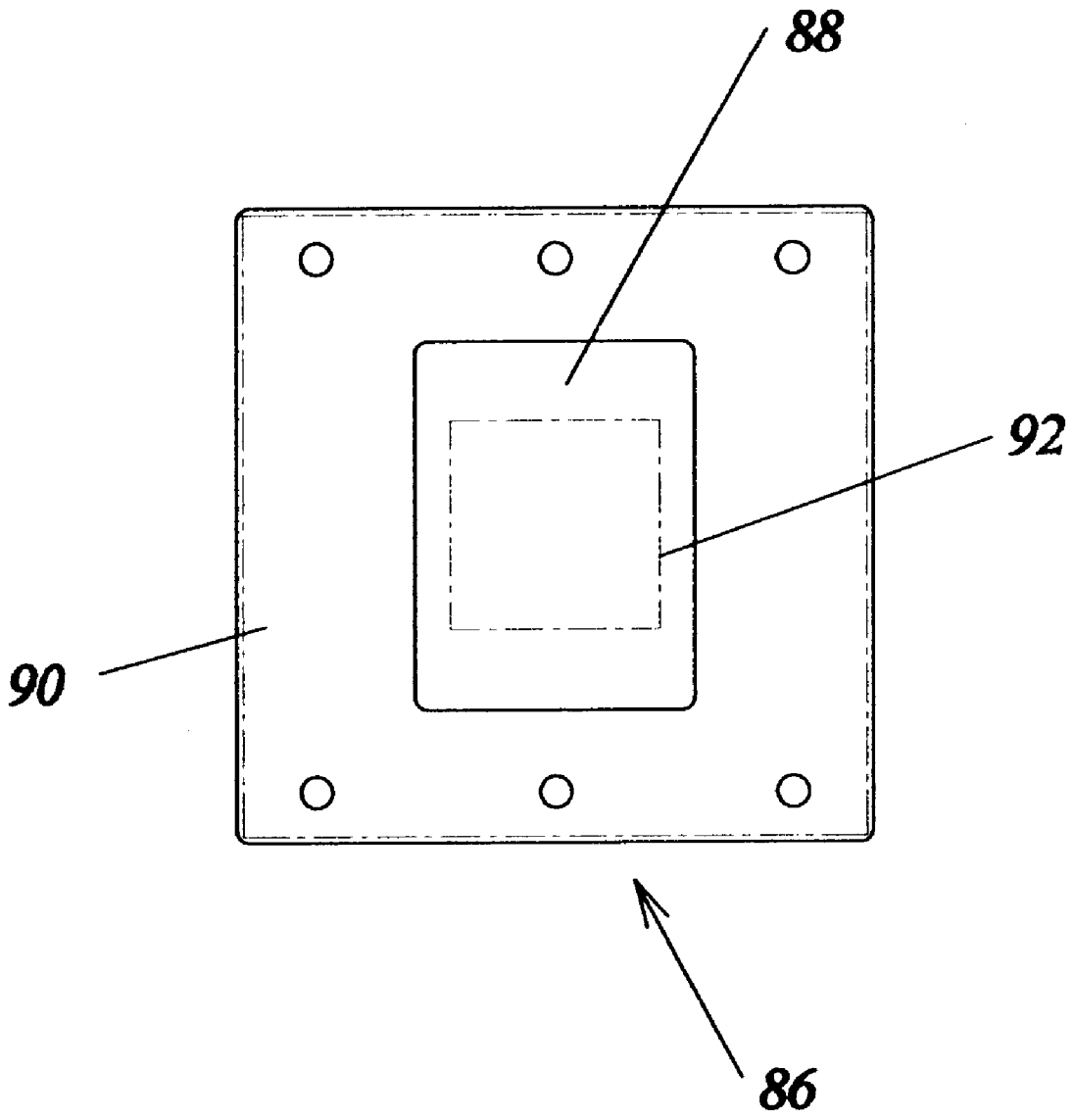
FIG. 18 is a top plan view of an end cap assembly.

FIG. 17 illustrates one possible means for securing support posts 16 and arms 22 to roof 14 when container 10 is in the erected position. A roof locking assembly 76 may be mounted adjacent the undersurface of roof 14 for this purpose. The assembly 76 of FIG. 17 includes a housing 78 bolted to a flange 80 depending from an edge of roof 14. Assembly 76 may include a spring-loaded pin 82 which slides within housing 78. In the locked position, pin 82 extends through housing 78 into an aperture 83 formed at the upper end of a support post 16 or arm 22 (FIGS. 2 and 15) to secure such support post in an upright orientation. Pin 82 may be manually withdrawn into the housing against the bias of the spring to disengage the support post and arms 16, 22 from roof 14. The inner end of pin 82 may include a handle loop 84 fastened with a strap (not shown) to flange 80. Since each pin 82 is spring-loaded, it will automatically snap into a corresponding aperture 83 when roof is slid upwardly to the erected position as shown in FIG. 17.

As should be apparent to someone skilled in the art, many other functionally equivalent means for releasably securing support posts and arms 16, 22 to roof 14 could be envisioned.

As shown best in FIGS. 1, 9, 17 and 18, end cap assemblies 86 may be used to seal the four apertures 17 in roof 14 when container 10 is in the erected position. Each assembly 86 preferably include a shoe 88 which is tightly fitted into the upper end of a support post 16. Shoe 88 acts as a stop restraining further upward sliding movement of roof 14. As shown best in FIG. 17, each end cap assembly 86 also preferably includes a metal plate 90 and a rubber grommet 92 to provide a moisture seal. In addition to functioning as a stop, end cap assemblies 86 prevent rain water and the like from entering into the interior of support posts 16 through roof apertures 17 when cargo container 10 is in use.

In operation, when container 10 is in the erected position shown in FIG. 1, it may be loaded with cargo in a conventional fashion. Once the container is fully loaded, the fabric panel 26 forming the front door 29 of container 10 is unrolled and strap clasps 32 are secured to hold-down track 34 (which extends along the perimeter of container base 12). Strap clasps 32 spaced along the vertical edges of door 29 are also fastened to adjacent container walls 26 as described above. Straps 30 are then cinched tight against the outer surface of wall panels 28.

Container 10 is loaded into the cargo hold of an aircraft in the usual fashion. As explained above, the configuration of container 10 may be adjusted to suit the particular dimensions and shape of the cargo hold.

At the destination, containers 10 are unloaded by loosening straps 30, unfastening selected clasps 32, and rolling door panel 29 to the open position shown in FIG. 1 to gain access to the interior of container 10. After container 10 has been unloaded, it may be maintained in the erected configuration for reuse on other flights. However, if it is necessary to return containers 10 unloaded to the base of operations, or some other location, each container 10 may be quickly knocked down to its fully collapsed configuration shown in FIG. 3 and stacked for shipment. This may be achieved by releasing roof locking assemblies 76 from support posts 16 and support arms 22. Support arms 22 may then be folded about hinges 75 onto pallet extension base 20 and base 20 and support assembly 24 may be folded on to container base 12 as described above. Roof 14 may then be slid downwardly relative to support posts 16 as shown in FIG. 2. In the fully collapsed position shown in FIG. 3, the undersurface of roof 14 is supported by brackets 44, a short distance above container base 12. All of the light weight, flexible walls 26 are stowed in the space between base 12 and roof 14.

The last step in the procedure is to slide each support post 16 upwardly until its post insert 46 is clear of the sleeve 40 of a corresponding post support 38. Each support post 16 may then be pivoted relative to a post support 38 and folded onto the top surface of container roof 14 as shown in FIG. 3. In this fully collapsed position, container 10 is approximately 15–20% of its fully erected height. Accordingly, up to six collapsible containers 10 may be shipped back to the base of operations in the same space conventionally taken by one empty unit load device.

When not in use, an inventory of containers 10 may be maintained in their fully collapsed configuration at the base of operations to minimize storage space requirements. When required, containers 10 may be quickly raised to the fully erected position as described in detail above.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A collapsible cargo container comprising:

(a) a base;

(b) a plurality of support posts each having a first end and a second end;

(c) a plurality of fasteners, wherein each of said fasteners operatively couples said first end of one of said support posts to said base to allow each support post to move between an extended position extending upwardly from said base and a folded position extending in a plane parallel to said base; and (d) a roof having a plurality of apertures formed therein wherein each of said apertures is sized to permit a corresponding one of said support posts to pass therethrough, thereby allowing said roof to slide substantially along the length of said support posts, when said support posts are in said extended position, between a deployed position distal from said base and a collapsed position proximate to said base, wherein said roof is releasably connectable to said second end of each of said support posts in said deployed position.

2. The cargo container of claim 1, further comprising flexible wall panels extending between said roof and said base in said deployed position.

3. The cargo container of claim 2, wherein said flexible wall panels comprise an outer web of adjustable straps which are releasably connectable to said base.

4. The cargo container of claim 1, wherein said first end of each of said support posts is pivotably coupled to said base.

5. The cargo container of claim 1, wherein said support posts extend above said roof when said roof is in said collapsed position and said support posts are in said folded position.

6. The cargo container of claim 1, wherein said roof extends in planes parallel to said base in said deployed and said collapsed positions.

7. The cargo container of claim 6, wherein said roof is supported by said fasteners a short distance above said base in said collapsed position.

8. The cargo container of claim 7, wherein said flexible wall panels are stowed between said roof and said base in said collapsed position.

9. The cargo container of claim 1, wherein said base and said roof are rigid.

10. The cargo container of claim 1, wherein said fasteners comprise a plurality of support sleeves extending upwardly from said base, each support sleeve for receiving one of said support posts.

11. The cargo container of claim 10, wherein said sleeves each comprise a bracket for supporting said roof above said base in said collapsed position.

12. The cargo container of claim 10, wherein said base is rectangular and said sleeves are located at corner portions of said base.

13. The cargo container of claim 10, wherein each of said support posts is slidably and pivotably coupled to one of said sleeves.

14. The cargo container of claim 10, wherein each of said support posts comprises a bayonet pin assembly mounted at said first end, and wherein each of said sleeves comprises a slot for slidably receiving said bayonet pin assembly.

15. The cargo container of claim 14, wherein each of said support posts is pivotable relative to one of said sleeves when said bayonet pin is lifted to the upper end of said slot.

16. The cargo container of claim 10, wherein each of said sleeves is sized to snugly receive one of said support posts in said extended position.

17. The cargo container of claim 1, wherein the surface area of said roof is greater than said base.

18. The cargo container of claim 17, further comprising a pallet extension pivotably coupled to said base and moveable between extension deployed and extension collapsed positions, wherein said pallet extension extends outwardly of said base beneath said roof in said extension deployed position.

19. The cargo container of claim 18, wherein said pallet extension further comprises:

(a) a pallet extension base;

(b) a pallet extension support assembly having an upper end pivotably coupled to said pallet extension base and a lower end pivotably coupled to said base of said container; and (c) pallet extension support arms hingedly coupled to said pallet extension base and moveable between a first position extending vertically between said pallet extension base and said roof in said extension deployed position, and a second position folded on to said pallet extension base.

20. The cargo container of claim 19, wherein said pallet extension base extends in a plane parallel to said roof and said base of said container in said extension deployed position.

21. The cargo container of claim 20, wherein said pallet extension base further comprises pin projections for releasably engaging said support posts in said extension deployed position.

22. The cargo container of claim 19, further comprising at least one flexible wall panel extending between said pallet extension base and said roof in said extension deployed position.

23. The cargo container of claim 18, wherein said pallet extension rests on an upper surface of said base beneath said roof in said extension collapsed position.

24. The cargo container of claim 1, further comprising locking means for releasably coupling said roof to said support posts in said deployed position.

25. The cargo container of claim 24, wherein each of said support posts has an aperture formed at said second end thereof and wherein said locking means comprises a plurality of locking pins mounted adjacent an undersurface of said roof which are slidable into said apertures when said roof is moved to said deployed position.

26. The cargo container of claim 25, wherein said locking pins are biased toward a locking position extending into said apertures.

27. The cargo container of claim 1, wherein each of said support posts further comprises a cap asssembly mounted at said second end for sealing one of said apertures formed in said roof in said deployed position.

28. The cargo container of claim 1, wherein the height of said container in said collapsed position is between 15–20% of the height of said container in said deployed position.

29. A collapsible cargo container comprising:

(a) a base;

(b) a plurality of support posts each having a first end and a second end;

(c) fastening means for operatively coupling said first end of each of said support posts to said base, wherein each support post is movable between an extended position extending upwardly from said base and a folded position extending in a plane parallel to said base; and (d) a roof slidably coupled to said support posts and moveable between a deployed position and a collapsed position, wherein said roof is releasably connectable to said second end of each of said support posts in said deployed position, wherein said roof comprises a plurality of apertures extending therethrough for slidably receiving said support posts and wherein said support posts extend above said roof when said roof is in said collapsed position and said support posts are in said folded position.

30. The cargo container of claim 29, wherein said fastening means further comprises at least one support cable extending between said base of said container and said pallet extension base in said extension deployed position.

31. A collapsible cargo container comprising:

(a) a base;

(b) a plurality of support posts each having a first end and a second end;

(c) fastening means for operatively coupling said first end of each of said support posts to said base, wherein each support post is movable between an extended position extending upwardly from said base and a folded position extending in a plane parallel to said base; and (d) a roof slidably coupled to said support posts and moveable between a deployed position and a collapsed position, wherein said roof is releasably connectable to said second end of each of said support posts in said deployed position, wherein said roof comprises a plurality of apertures extending therethrough for slidably receiving said support posts and wherein each of said support posts further comprises a cap assembly mounted at said second end for sealing one of said apertures formed in said roof in said deployed position.

32. A collapsible cargo container comprising:

(a) a base;

(b) a plurality of support posts each having a first end and a second end;

(c) fastening means for operatively coupling said first end of each of said support posts to said base, wherein each support post is movable between an extended position extending upwardly from said base and a folded position extending in a plane parallel to said base;

(d) a roof slidably coupled to said support posts and moveable between a deployed position and a collapsed position, wherein said roof is releasably connectable to said second end of each of said support posts in said deployed position, the surface area of said roof being greater than said base; and (e) a pallet extension pivotably coupled to said base and moveable between extension deployed and extension collapsed positions, wherein said pallet extension extends outwardly of said base beneath said roof in said extension deployed position.

* * * * *